United States Patent [19]

Harpula et al.

[11] 3,943,089

[45] Mar. 9, 1976

[54] QUICK-HARDENING CORE AND MOLDING SAND COMPOSITION, AND A METHOD FOR ITS HARDENING

[75] Inventors: Jan Harpula; Jur Piszak; Mieczyslaw Debski; Tadeusz Rzepa; Jerzy Sliwa; Andrzej Heryan, all of Krakow, Poland

[73] Assignee: Instytut Odlewnictwa, Krakow, Poland

[22] Filed: May 24, 1974

[21] Appl. No.: 473,314

Related U.S. Application Data

[63] Continuation-in-part of Ser. No. 273,957, July 21, 1972, abandoned.

[30] Foreign Application Priority Data

Dec. 27, 1971 Poland ..... 152497

[52] U.S. Cl. ..... 260/33.6 UA; 164/43; 260/42.43; 260/DIG.40; 260/998.18

[51] Int. Cl.[2] ..... B22C 1/22

[58] Field of Search ..... 260/42.25, 42.43, 33.6 UA, 260/DIG. 40, DIG. 998.18; 106/38.25; 164/43

[56] References Cited

UNITED STATES PATENTS

| | | | |
|---|---|---|---|
| 2,444,413 | 7/1948 | Weston | 260/998.18 X |
| 2,491,006 | 8/1947 | Grube | 260/DIG. 40 X |
| 2,503,088 | 4/1950 | Barlow | 260/998.18 X |
| 2,765,507 | 10/1956 | Wolf et al. | 260/998.18 X |
| 2,854,715 | 10/1958 | Kura | 260/998.18 X |
| 2,991,267 | 7/1961 | Bean | 260/998.18 X |
| 3,005,245 | 10/1961 | Howard | 260/998.18 X |
| 3,024,215 | 3/1962 | Freeman et al. | 260/998.18 X |
| 3,074,802 | 1/1963 | Alexander et al. | 260/998.18 X |
| 3,107,403 | 10/1963 | Moore | 260/DIG. 40 X |
| 3,121,268 | 2/1964 | Rubens | 260/998.18 X |
| 3,135,029 | 6/1964 | Cooper et al. | 260/998.18 X |
| 3,318,840 | 5/1967 | Weston | 260/998.18 X |
| 3,679,703 | 7/1972 | Conrady et al. | 260/41 A |

OTHER PUBLICATIONS

Schaller, Engineering Manufacturing Methods, (McGraw-Hill, 1959), p. 94.

*Primary Examiner*—Murray Tillman
*Assistant Examiner*—T. De Benedictis, Sr.
*Attorney, Agent, or Firm*—Haseltine, Lake & Waters

[57] ABSTRACT

A quick-setting core and molding sand comprising quartz sand, a binder and an adsorbent or absorbent. The binder is a solution of a binding agent such as polystyrene, polyvinyl acetate or the like in an appropriate organic solvent. After molding, the sand is hardened by means of blowing it with an inert gas, preferably air or applying a suction thereto. The time of hardening is very short and depends upon the size of a mold or a core which is being made.

5 Claims, No Drawings

QUICK-HARDENING CORE AND MOLDING SAND COMPOSITION, AND A METHOD FOR ITS HARDENING

CROSS RELATED APPLICATION

This application is a continuation-in-part of application Ser. No. 273,957 filed July 21, 1972 and now abandoned.

BACKGROUND a. Field of the Invention

The invention relates to a quick-hardening core and molding sand and a method for hardening thereof.

b. Prior Art

Quick-hardening core and molding sands are known based on quartz sand and containing water-glass as a binder and these sands have been hardened by means of blowing them with carbonic acid anhydride.

In the case of molds and cores made of molding sand with addition of various kinds of synthetic resins, hardening is achieved by means of blowing these molds and cores with a catalyst in the form of a gas, e.g. hydrogen chloride, or with a liquid catalyst in the form of a mist, e.g. triethylamine, or by adding the catalyst to the molding sand together with the resin.

Utilization of these molding sands and their methods of hardening have caused numerous troubles as regards the use of highly toxic gases or catalysts, in which case it is necessary to construct special apparatus and very tight devices for the supply of these gases or catalysts.

Moreover, molds and cores produced by means of the known methods require a relatively long time for complete hardening of the sand. This time depends on the size of the core or mold and on the degree of complexity of their shape and, on an average, the time amounts to approximately 4 hours.

Another method for making foundry cores is described in U.S. Pat. No. 3,679,703 and consists in using a copolymer of styrene with acrylic acid. The process of binding the sand is a result of the chemical reaction which occurs after adding acrylic acid and styrene in a ratio of 1 : 4, the water formed during this reaction being removed in a dehydrating operation. This method is highly complicated.

Another method for conditioning foundry sand is described in U.S. Pat. No. 2,491,006 and comprises mixing an appropriate amount of the foundry sand in a mixer at elevated temperature and adding thereto an appropriate heavy petroleum residue. However, this does not confer to thus obtained moulding or core sand thermohardening properties. Moreover, according to this method it is necessary to heat the sand to a temperature of 400°–500°F. The obtained core or moulding sand mixture shows high green strength and only moderate dry strength. Usually, the sand composition contains also an addition of the commonly used bonding clays or other binders and an appropriate amount of water. The fact that the sand must be heated as well as its low dry strength detract from its value.

SUMMARY OF THE INVENTION

It is an object of the present invention to remove these disadvantages and to shorten the time required for a complete hardening of the sand.

Another object of the invention is to provide a molding or core sand of a special composition and also to provide a method for the quick hardening of this sand which eliminates the necessity of using toxic gases.

These objects are achieved by establishing a composition of the molding or core sand based on foundry sand, e.g. quartz sand and containing a binding agent, in the form of polystryrene having a molecular weight from 100,000 to 350,000 or its derivatives, i.e. chemical compounds having the basic structure of polystyrene and varying from it only in the number and type of substituents or the place of substition, such as the polymer of alpha-methyl-styrene, the polymer of beta-phenyl-styrene or copolymers of styrene, or other suitable materials, such as polyvinyl acetate, methyl polymethacrylate or their derivatives, or the derivatives of cellulose, such as ethyl cellulose, methyl cellulose or a mixture of the above said compounds, in an organic solvent selected from the group of aliphatic or aromatic hydrocarbons, halogen derivatives of hydrocarbons, esters, ketones, alcohols and the like.

As derivatives of methyl polymethacrylate are contemplated compounds having the chemical structure of methyl polymethacrylate and varying from this compound only in the number and type of substituents or place of substitution e.g. ethyl polymethacrylate.

Similarly, as derivatives of polyvinyl acetate are contemplated compounds having the chemical structure of polyvinyl acetate and varying from this compound only in the number and type of substituents or place of substitution.

As previously noted the range of molecular weight of polystyrene is from 100,000 to 350,000. While carrying out tests it has been found that polystyrene whose molecular weight is included in the above-mentioned range, confers sufficient mechanical strength to thus produced cores and provides the short time of hardening.

Preferably, the binder solution has a 10 to 65% concentration.

In addition to the binding agent and the solvent, the sand according to the invention also includes adsorbents, such as zeolite and/or absorbents, such as, kerosene, the additives being present in a maximum amount of 10 parts by weight per 100 parts by weight of the foundry sand and, additionally up to 1 part by weight of powdered materials having a high specific surface, such as coal dust, metal oxides, aluminum powder and the like.

The binder is introduced into the sand in the amount of 1 to 10 parts by weight per 100 parts by weight of the foundry sand.

The method of hardening the sand, according to the invention, comprises removing volatile solvent, for example, by means of blowing the sand with a non-toxic gas, preferably air or its components at a pressure of 0.2 to 6 atmospheres at room temperature for a time of at least 5 seconds.

The solvent can also be removed from the sand by means of suction or by combined blowing and suction at the same time.

The time for removing the volatile solvent from the sand for a complete hardening of this sand depends on the size of the mold or core and on the degree of complexity of their shape.

The sand according to the invention is characterized by very good technological properties. The sand and its method for its hardening can be applied both in piece and lot production of castings. The sand composition can be used in the production of molds and cores in the case of accessories made of both wood and of plastic or metal.

The cores made according to the present invention can be shaped both as common cores or shell cores and the sand inside the core which has not been hardened can further be used in the next step of the core production.

The method of producing the sand composition according to the present invention will next be described by means of the following examples.

DESCRIPTION OF PREFERRED EMBODIMENTS

EXAMPLE I

1–10 parts by weight of polystyrene binder of a concentration of 10–65% is added to 100 parts by weight of quartz sand mixed with kerosene. The ingredients are mixed in a mixer for a period of about 1 to 2 minutes.

From the thus prepared sand composition, cores or molds are made using conventional molding equipment and then the sand composition is hardened by means of blowing compressed air therethrough under a pressure of 1.5 atmospheres for a period of time ranging from 5–150 seconds.

EXAMPLE II 0.2–2 parts by weight of powdered polystyrene and 0.5–2 parts by weight of polyvinyl acetate are added to 100 parts by weight of olivine sand mixed with 1 part by weight of zeolite. After mixing the composition, 1.5–6 parts by weight of ethyl acetate are added and the entire mixture is mixed again in a mixer for about 2 minutes.

From the thus prepared sand, cores or molds are made which are subjected to subsequent hardening by means of removing the volatile solvent under suction.

The thus recovered solvent, i.e. ethyl acetate, can be reused after condensation for further production.

EXAMPLE III 3 parts by weight of powdered polystyrene are added to 100 parts by weight of quartz sand heated to a temperature of approximately 100°C, the ingredients being vigorously mixed in a mixer in order to coat the sand grains with melted polystyrene.

Then the thus coated and cooled sand is mixed again in a mixer adding thereinto up to 8 parts by weight of trichloroethylene over a period of time of approximately 2 minutes.

From the thus prepared sand, cores are made which then are hardened by means of removing the volatile solvent from the mixture by an operation of blowing air into the core from one side while applying a suction force at the other side.

EXEMPLARY SAND COMPOSITIONS ACCORDING TO THE INVENTION

| | |
|---|---|
| **EXAMPLE A** | |
| Quartz sand | 100 parts by weight |
| Coal dust | 1 part by weight |
| Solution of polystyrene in carbon tetrachloride (concentration 30%) | 5 parts by weight |
| **EXAMPLE B** | |
| Quartz sand | 100 parts by weight |
| Talc | 0.5 parts by weight |
| Solution of polyphenylstyrene in chloroform (concentration 10%) | 10 parts by weight |

-continued

EXEMPLARY SAND COMPOSITIONS ACCORDING TO THE INVENTION

| | |
|---|---|
| **EXAMPLE C** | |
| Olivine sand | 100 parts by weight |
| Calcium oxide | 1 part by weight |
| Solution of polystyrene in trichloroethylene (concentration 65%) | 3 parts by weight |
| **EXAMPLE D** | |
| Quartz sand | 100 parts by weight |
| polyvinyl acetate | 1.5 parts by weight |
| Ethyl acetate | 5 parts by weight |
| **EXAMPLE E** | |
| Quartz sand | 100 parts by weight |
| Magnesium oxide | 1 part by weight |
| Solution of polystyrene and polyvinyl acetate in a 3:1 ratio in ethyl acetate (concentration 25%) | 4 parts by weight |
| **EXAMPLE F** | |
| Quartz sand coated with powdered polystyrene, in a ratio of 100:2 | 100 parts by weight |
| Zeoline X | 0.5 parts by weight |
| Benzene | 8 parts by weight |
| **EXAMPLE G** | |
| Quartz sand coated with powdered polyvinyl acetate | 100 parts by weight |
| Zeolite X | 0.5 parts by weight |
| Benzene | 8 parts by weight |
| **EXAMPLE H** | |
| Olivine sand | 100 parts by weight |
| Solution of polystyrene and ethyl cellulose in a ratio of 5:1 in trichloroethylene (concentration 20%) | 4 parts by weight |
| **EXAMPLE J** | |
| Zircon sand | 100 parts by weight |
| Silica gel | 3 parts by weight |
| Solution of polystyrene and methyl polymethacrylate in a ratio of 10:1 in acetone (concentration 20%) | 5 parts by weight |
| **EXAMPLE K** | |
| Zircon sand | 100 parts by weight |
| Kerosene | 0.5 parts by weight |
| Solution of methyl polymethacrylate in trichloroethylene (concentration 15%) | 5 parts by weight |

What is claimed is:

1. A quick-hardening core and molding sand composition comprising quartz sand and a binder solution, said binder solution comprising a binding agent of molecular weight of 100,000–350,000 selected from the group consisting of polystyrene, polyvinyl acetate, polymethylmethacrylate, polyethyl-methacrylate, derivatives of cellulose, and mixtures thereof, and an organic solvent for the binding agent selected from the group consisting of aliphatic and aromatic hydrocarbons, said binding agent being present in said solution in a concentration of 10 to 65%.

2. A sand composition as claimed in claim 1 wherein the binding agent is present in the amount of 0.1–10 parts by weight and the organic solvent is present in the amount of 0.1–10 parts by weight, per 100 parts by weight of the sand.

3. A sand composition as claimed in claim 2 further containing at least one absorbent or adsorbent in a maximum amount of 10 parts by weight per 100 parts by weight of the sand.

4. A sand composition as claimed in claim 2 further containing a powdered material of high specific surface, in an amount not greater than 1 part by weight per 100 parts by weight of sand.

5. A sand composition as claimed in claim 4 wherein said powdered material is coal dust, a metal oxide, or aluminum powder.

* * * * *